US008764142B2

(12) United States Patent
Teramae

(10) Patent No.: US 8,764,142 B2
(45) Date of Patent: Jul. 1, 2014

(54) LIQUID EJECTION APPARATUS AND CONTROL METHOD THEREOF

(75) Inventor: Hirofumi Teramae, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 67 days.

(21) Appl. No.: 13/301,734

(22) Filed: Nov. 21, 2011

(65) Prior Publication Data

US 2012/0127225 A1 May 24, 2012

(30) Foreign Application Priority Data

Nov. 22, 2010 (JP) ..... 2010-260221

(51) Int. Cl.
*B41J 29/38* (2006.01)

(52) U.S. Cl.
USPC ..... 347/10

(58) Field of Classification Search
USPC ..... 347/5–20, 68, 70, 75
IPC ..... B41J 29/38
See application file for complete search history.

(56) References Cited

U.S. PATENT DOCUMENTS

| | | | | |
|---|---|---|---|---|
| 6,464,315 | B1 * | 10/2002 | Otokita et al. | 347/9 |
| 7,384,111 | B2 | 6/2008 | Hosono | |
| 2004/0257391 | A1 * | 12/2004 | Hosono | 347/11 |
| 2010/0103209 | A1 * | 4/2010 | Otokita | 347/10 |
| 2010/0220134 | A1 * | 9/2010 | Matsushita | 347/10 |

FOREIGN PATENT DOCUMENTS

JP 2004-299348 A 10/2004

* cited by examiner

*Primary Examiner* — Manish S Shah
*Assistant Examiner* — Roger W Pisha, II
(74) *Attorney, Agent, or Firm* — Kilpatrick Townsend & Stockton LLP

(57) ABSTRACT

A drive signal generating circuit of the liquid ejection apparatus may output a second drive signal including a first unit signal including a set of two ejection drive pulses, and a fine vibration drive pulse, and a second unit signal including a set of two ejection drive pulses; and at a steady speed area of the recording head, both the first unit signal and the second unit signal are output according to one timing signal while at an acceleration or deceleration area of the recording head, one first unit signal is output according to one timing signal.

6 Claims, 6 Drawing Sheets

FIG. 6
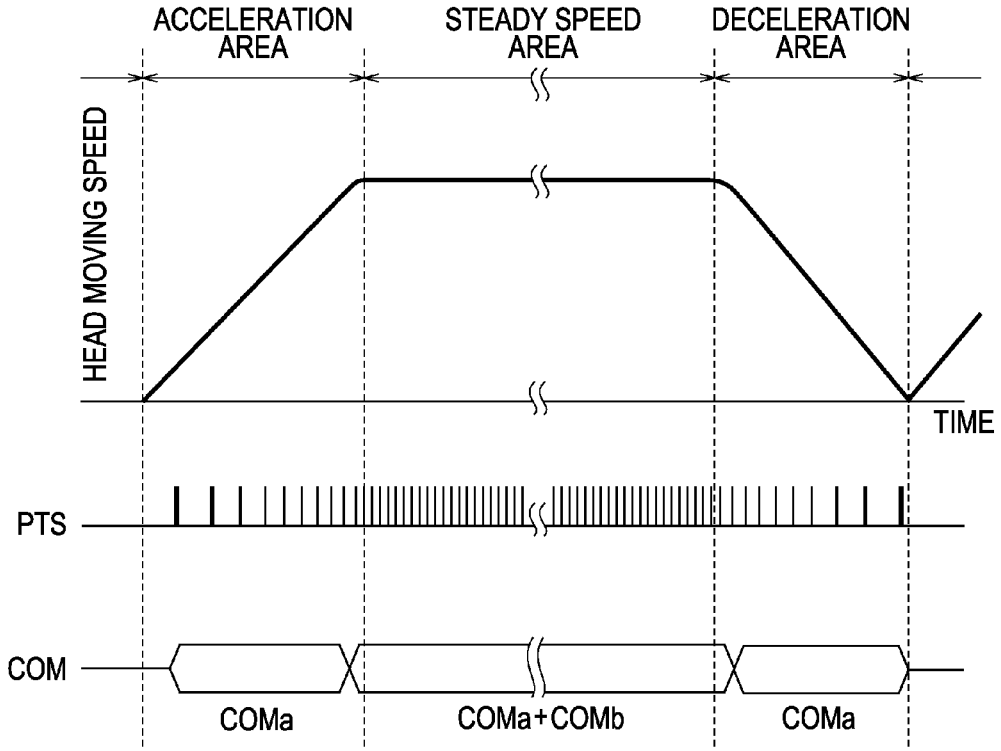
FIG. 7A
FIG. 7B
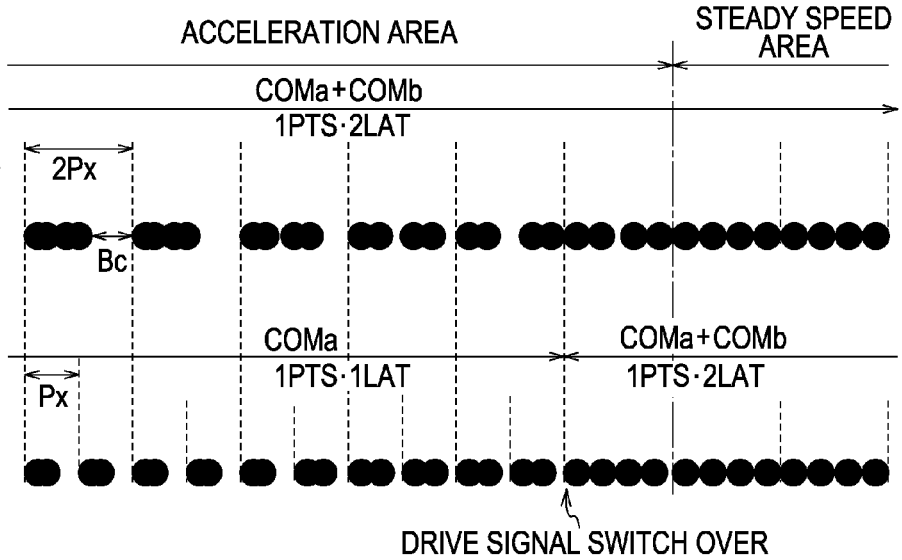

LIQUID EJECTION APPARATUS AND CONTROL METHOD THEREOF

BACKGROUND

1. Technical Field

The present invention relates to a liquid ejection apparatus such as an ink jet type recording apparatus or the like and a control method thereof, in particular to a liquid ejection apparatus in which a liquid ejection head is moved with respect to a landing object while liquid is ejected from a nozzle and a control method thereof.

2. Related Art

A liquid ejection apparatus is an apparatus that includes an ejection head and in which all types of liquid are ejected from the ejection head. As the liquid ejection apparatus, for example, there is an image recording apparatus such as an ink jet type printer, an ink jet type plotter or the like. Furthermore, recently, characteristics in which an extremely small amount of liquid is exactly landed on a predetermined position, have been applied to various apparatuses. For example, it applies to a display manufacturing apparatus for manufacturing color filters of liquid crystal display or the like, an electrode forming apparatus for forming electrodes of an organic EL (Electro Luminescence) display and a FED (field emission display) or the like, and a chip manufacturing apparatus for manufacturing biochips (biochemical elements). Thus, liquid-phased ink is ejected at the recording head for image recording apparatus, and each of color material liquid of R (Red) G (Green) B (Blue) is ejected at a color material ejection head for a display manufacturing apparatus. In addition, liquid-phased electrode material is ejected at the electrode material ejection head for the electrode forming apparatus and liquid of a bioorganic substance is ejected at the bioorganic substance ejection head for the chip manufacturing apparatus.

In this type of liquid ejection apparatus, a pressure generation unit (for example, a piezoelectric transducer or a heating element) that is included in the liquid ejection head is driven to generate a drive signal that includes an ejection drive pulse that ejects liquid from a nozzle of the liquid ejection head or a fine vibration drive pulse that finely vibrates a meniscus at the nozzle. In addition, each of drive pulses that are included in the drive signal is selectively applied to a pressure generation unit so that ejection control or fine vibration control of liquid is performed. The above described drive signal is repeatedly generated according to a timing signal that is generated based on a position signal according to a reciprocating movement of the liquid ejection head, in other words, a movement position of the recording medium such as the recording paper (landing object of liquid). Accordingly, the liquid ejection may be synchronized with the moving of the main scanning direction of the liquid ejection head and accuracy of the landing position of liquid with respect to the recording medium may be increased. Generally, a generation period of the drive signal is set to a time corresponding to an ejection resolution (a recording resolution) with respect to the recording medium. For example, in a case of the printer, when one pixel is recorded, the time that corresponds to a movement distance of the recording head and the generation period of the drive signal are set to accord with each other.

In the above described liquid ejection apparatus, there is strong demand with respect to increasing the speed of the liquid ejection. Thus, it is required that a pressure generation unit (for example, a piezoelectric transducer or a heating element) that is included in the liquid ejection head is operated in a further short interval. Thus, it is required that the generation period of the drive signal is shortened. However, the above described fine vibration pulse is only for finely vibrating the meniscus and is not directly related to the ejection of liquid droplets. Thus, in a configuration where the fine vibration pulse is input per every generation period of the drive signal, the generation period of the drive signal is extended as much as the fine vibration pulse and an obstacle with respect to the increased speed of the liquid ejection occurs.

Regarding the above described problem, as is disclosed in JP-A-2004-299348, a liquid ejection apparatus is configured such that a drive signal is generated, in which a first drive signal (a first unit period signal) that includes both an ejection drive pulse and a fine vibration drive pulse, and a second drive signal (a second unit period signal) that is configured of only the ejection drive pulse without including the fine vibration drive pulse are mixed in one signal generation period that is defined as one timing signal. In other words, in the related art, the fine vibration drive pulse is generated whenever one drive signal is generated, while one fine vibration drive pulse is generated whenever two unit period signals are generated in the configuration of JP-A-2004-299348.

However, in a liquid ejection apparatus of the related art, acceleration or deceleration of the liquid ejection head is performed at a position that is outside of the lateral in a movement direction of a head from a liquid ejection area (in a case of a printer, a recording area of an image or the like) in a landing object. The liquid ejection is not performed at the acceleration or the deceleration area. In other words, the liquid ejection is performed only at the steady speed area of the liquid ejection head. Meanwhile, recently, since there is demand for improvement of a processing speed of the liquid ejection and a more compact size of the apparatus, a configuration is also employed in which the movement distance (a scanning distance) of the liquid ejection head is shortened, the acceleration and the deceleration (in other words, direction switchover operation) of the liquid ejection head is performed even on the liquid ejection area at the landing object, and the ejection is performed in the acceleration and the deceleration section. However, if ink is ejected in the acceleration and the deceleration area, since the movement speed of the liquid ejection head is slower compared to a steady speed period in which the movement speed of the liquid ejection head is constant, the landing position of the liquid may be biased at the landing object. Specifically, like the configuration that is disclosed in JP-A-2004-299348, in a configuration in which a plurality of unit period signals is included in one signal generation period that is defined as one timing signal, dots are formed on the landing object with substantially the same interval at the steady speed period while the forming position of the dots is biased on the landing object in the acceleration and the deceleration area. Accordingly, striping and uneven coloration may occur in the image that is recorded on the landing object such that there is a problem in that the image quality is decreased.

SUMMARY

An advantage of some aspects of the invention is provided that a liquid ejection apparatus and a control method thereof, in which a bias of a forming position of dots on a landing object may be suppressed in a configuration where liquid is ejected at an acceleration or deceleration area of a liquid ejection head.

According to an aspect of the invention, there is provided a liquid ejection apparatus including: a liquid ejection head having a pressure generating unit that generates a pressure variation to liquid inside of a pressure chamber communicating to a nozzle, and ejecting liquid from the nozzle according to driving of the pressure generating unit, and a drive signal generating unit repeatedly generating a drive signal according to a timing signal that is generated based on movement of the liquid ejection head, wherein the drive signal includes an ejection drive pulse ejecting liquid from the nozzle and a fine vibration drive pulse finely vibrating a meniscus at the nozzle to a degree that the liquid is not ejected from the nozzle, wherein the drive signal generating unit outputs a first unit signal including a set of one or more ejection drive pulses and a fine vibration drive pulse and a second unit signal including a set of one or more ejection drive pulses and having a generation period that is shorter than that of the first unit signal, and wherein at a steady speed area of the liquid ejection head, both the first unit signal and the second unit signal are output according to one timing signal while at an acceleration or deceleration area of the liquid ejection head, the first unit signal is output according to one timing signal.

According to the aspect of the invention, at the steady speed area of the liquid ejection head, both the first unit signal and the second unit signal are output according to one timing signal while at an acceleration or deceleration area of the liquid ejection head, the first unit signal is output according to one timing signal. Accordingly, at the steady speed area, the generation period as many as two unit signals may be shortened by as much as one fine vibration drive pulse and the ejection of ink may be performed with higher frequency. Meanwhile, at the acceleration or deceleration area where the movement speed of the liquid ejection head is slower than that at the steady speed area, the bias of the landing position of liquid on the landing object is decreased. Thus, the blank between dots, which occurs according to the landing position of liquid being biased on the recording paper, may be decreased. As a result, for example, decreasing of the quality of the recording image may be suppressed. Accordingly, the driving of the liquid ejection head with higher frequency and secure landing accuracy of liquid with respect to the landing object may be compatible.

It is preferable that the drive signal generating unit perform switchover of the drive signal based on a threshold value regarding movement speed of the liquid ejection head.

It is preferable that the drive signal generating unit perform switchover of the drive signal based on a threshold value regarding the movement position of the liquid ejection head.

It is preferable that the threshold value vary whenever a movement direction of the liquid ejection head is switched over in every predetermined number of times.

According to the configuration, the threshold value is varied whenever the movement direction of the liquid ejection head is switched over a predetermined number of times. Accordingly, a position in which the bias of the landing position of liquid occurs according to the switchover of the drive signal at the landing object is varied corresponding to the movement direction of the liquid ejection head. Accordingly, the blank that occurs according to the bias of the landing position that is continuous in a direction orthogonal to the movement direction of the liquid ejection head is suppressed. As a result, a decrease of the quality of the recording image or the like may be suppressed.

According to another aspect of the invention, there is provided a control method of a liquid ejection apparatus including a liquid ejection head having a pressure generating unit that generates a pressure variation to liquid inside of a pressure chamber communicating to a nozzle, and ejecting liquid from the nozzle according to driving of the pressure generating unit, and a drive signal generating unit repeatedly generating a drive signal with a timing based on a timing signal that is output according to movement of the liquid ejection head, wherein the drive signal includes an ejection drive pulse ejecting liquid from the nozzle and a fine vibration drive pulse finely vibrating a meniscus at the nozzle to a degree that the liquid is not ejected from the nozzle, the method including: outputting a first unit signal and a second unit signal from the drive signal generating unit according to one timing signal at a steady speed area of the liquid ejection head, and outputting the first unit signal from the drive signal generating unit according to one timing signal at an acceleration or deceleration area of the liquid ejection head, wherein the first unit signal includes a set of one or more ejection drive pulses and a fine vibration drive pulse and the second unit signal includes a set of one or more ejection drive pulses and having a generation period that is shorter than that of the first unit signal.

BRIEF DESCRIPTION OF THE DRAWINGS

The invention will be described with reference to the accompanying drawings, wherein like numbers reference like elements.

FIG. 6 is a timing chart illustrating variation of the movement speed of the recording head, a timing pulse and a generation timing of the drive signal.

FIG. 7 is a schematic view illustrating a landing position of the dot in the acceleration area and in the steady speed area.

DESCRIPTION OF EXEMPLARY EMBODIMENTS

Embodiments of the invention will be described based on the accompanying drawings. In the embodiments that are described below, there are various limits as preferred specific examples of the invention, however the range of the invention is not limited to the embodiments as long as the purpose of the description does not specifically limit the invention in the description below. In the following description, as a liquid ejection apparatus of the invention, an ink jet type recording apparatus (hereinafter referred to as the printer) is taken as an example.

Figure 1:
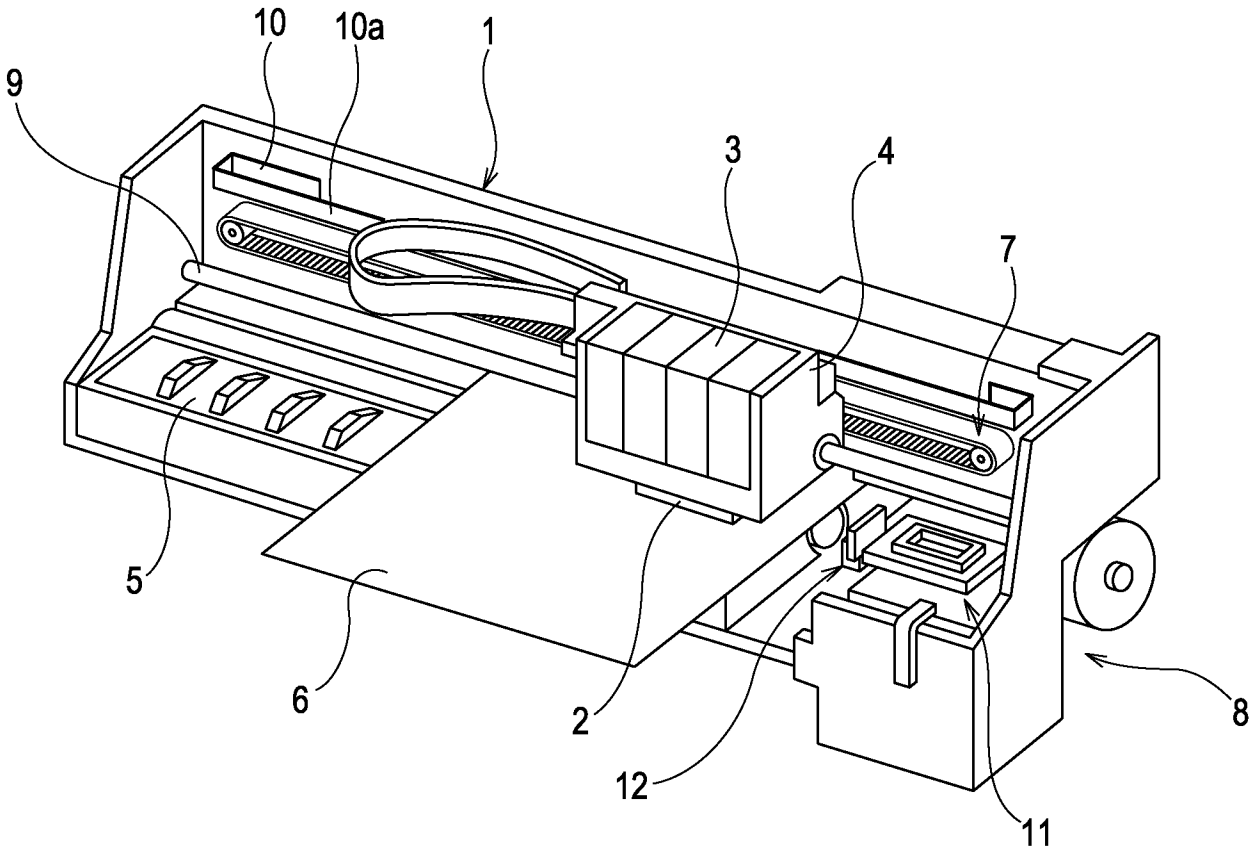
FIG. 1 is a perspective view explaining a configuration of a printer.

FIG. 1 shows a perspective view illustrating a configuration of a printer 1. The printer 1 is substantially configured including a carriage 4 where a recording head 2 that is a type of liquid ejection head is attached and an ink cartridge 3 that is a type of liquid supply source is detachably attached a platen 5 that is arranged at a lower side of the recording head 2 during a recording operation, a carriage moving mechanism 7 that reciprocates the carriage 4 in a paper width direction of a recording paper 6 (a type of landing object and a recording medium) in other words, in a main scanning direction, and a paper feeding mechanism 8 that transports the recording paper 6 in a sub-scanning direction that is orthogonal to the main scanning direction.

The carriage 4 is attached in a shaft supported state at a guide rod 9 that is suspended in the main scanning direction.

The carriage 4 is configured so as to move in the main scanning direction along the guide rod 9 according to the operation of the carriage moving mechanism 7. A linear encoder 10 detects a position of the carriage 4 in the main scanning direction and the detected signal, in other words, an encoder pulse (a type of positional information) is transmitted to a controller 43 (see FIG. 3) of a printer controller 38. The linear encoder 10 is a type of positional information output unit and outputs an encoder pulse EP according to a scanning position of the recording head 2 as the positional information in the main scanning direction. The linear encoder 10 in the embodiment includes a scale 10*a* (an encoder film) that is extended in the main scanning direction at the inside of the casing of the printer 1 and a photo interrupter (not shown) that is attached at a rear surface of the carriage 4. The scale 10*a* is a band-shaped member that is made from a transparent resin film. The scale 10*a* is configured such that for example, a plurality of opaque stripes crossing the bandwidth direction at the surface of the transparent base film is printed. The stripes are for example, formed in a same width and in a constant pitch in a band longitudinal direction respectively, corresponding to 180 dpi. In addition, the photo interrupter is configured of a pair of light emitting element and a light receiving element that are arranged opposed to each other, and outputs the encoder pulse EP according to difference between a light receiving state at the transparent portion of the scale 10*a* and a light receiving state at the stripe portion.

Since the stripes are formed in the same width and in the constant pitch, if a movement speed of the carriage 4 is constant, the encoder pulse EP is output at a constant interval, while, if the movement speed of the carriage 4 is not constant (during acceleration or deceleration), the interval of the encoder pulse EP varies according to the movement speed of the carriage 4. Thus, the encoder pulse EP is input into the controller 43. Accordingly, the controller 43 identifies the scanning position of the recording head 2 that is loaded on the carriage 4 based on the received encoder pulse EP. In other words, for example, the received encoder pulse EP is counted so that the position of the carriage 4 may be identified. Accordingly, the controller 43 identifies the scanning position of the carriage 4 (the recording head 2) based on the encoder pulse EP from the linear encoder 10 so that the recording operation may be controlled by the recording head 2.

At an end portion area of the further outside than a recording area within a moving range of the carriage 4, a home position that is a reference point of the scanning of the cartridge is set. A keeping member 11 that seals a nozzle forming surface (a nozzle plate 24: see FIG. 2) of the recording head 2 and a wiper member 12 for wiping the nozzle forming surface are arranged at the home position in the embodiment. Thus, the printer 1 is configured such that so-called both-direction recording that records characters, images or the like on the recording paper 6 in both directions may be performed during forward movement in which the carriage 4 moves toward an opposed end portion from the home position and during backward movement in which the carriage 4 returns to the home position from the opposed end portion.

Figure 2:
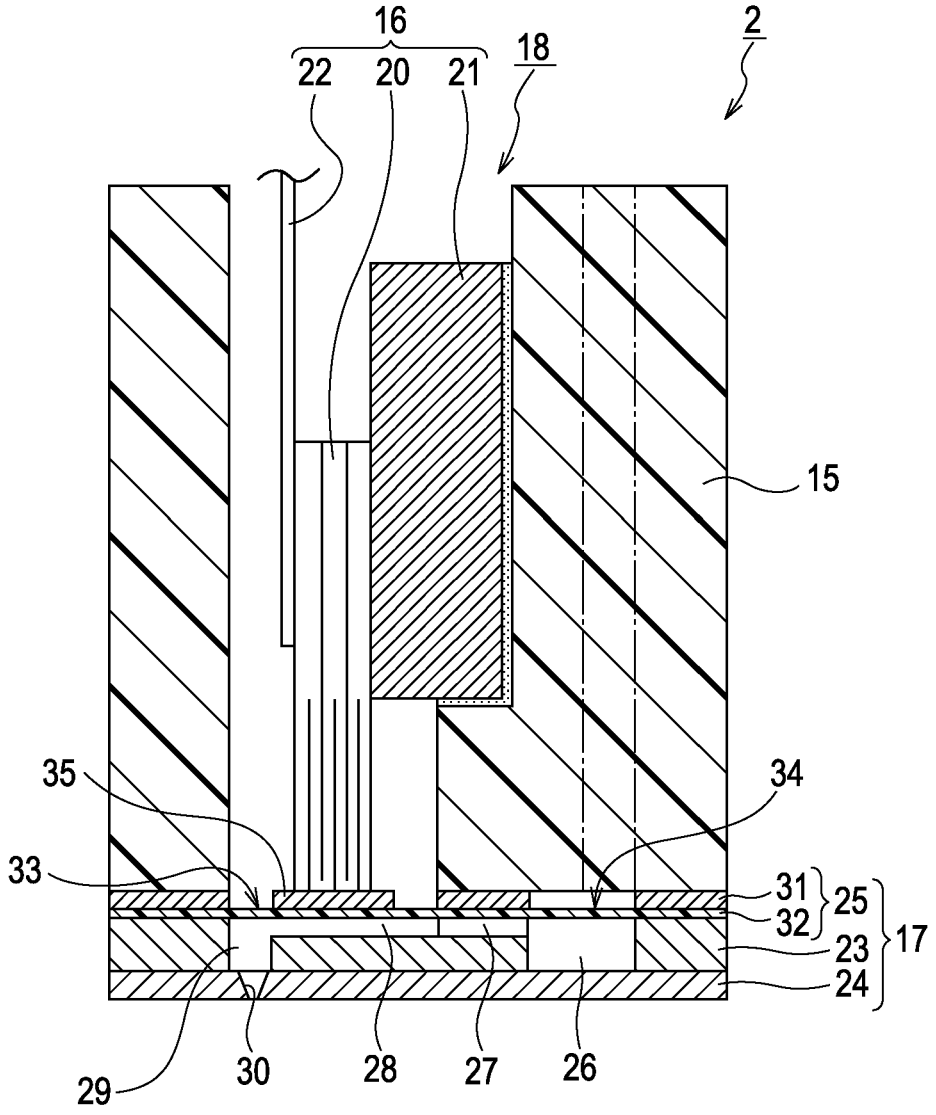
FIG. 2 is a cross sectional view of a main portion of the recording head.

FIG. 2 is a cross sectional view of a main portion of the recording head 2 explaining a configuration of the recording head 2. The recording head 2 includes a case 15, a transducer unit 16 that is accommodated in the case 15 and a flow passage unit 17 that is connected to a bottom surface (a front end surface) of the case 15. The case 15 is for example, made from epoxy resin and forms an accommodating space 18 so as to accommodate the transducer unit 16 inside thereof. The transducer unit 16 includes a piezoelectric transducer 20 that functions as a type of pressure generating unit, a fixing plate 21 where the piezoelectric transducer 20 is connected and a flexible cable 22 in order to supply a drive signal or the like to the piezoelectric transducer 20. The piezoelectric transducer 20 is a laminating type that is made by dividing a piezoelectric plate in a comb-shape in which a piezoelectric layer and an electrode layer are laminated alternatively. In addition, the piezoelectric transducer 20 is of a longitudinal vibration mode that is compandable (a transverse electric field effect type) in a direction orthogonal to a laminating direction (electric field direction).

The flow passage unit 17 is configured such that a nozzle plate 24 is connected to one surface of a flow passage forming substrate 23 and a vibration plate 25 is connected to the other surface of the flow passage forming substrate 23 respectively. A reservoir 26 (common liquid chamber), an ink supply port 27, a pressure chamber 28, a nozzle communication port 29 and a nozzle 30 are provided at the flow passage unit 17. Thus, a series of ink flow passages from the ink supply port 27 to the nozzle 30 through the pressure chamber 28 and the nozzle communication port 29 is formed corresponding to each nozzle 30.

The nozzle plate 24 is a metal thin plate such as stainless steel or the like where a plurality of the nozzles 30 is pored and provided in a row-shape with a pitch (for example, 180 dpi) corresponding to a dot forming density. At the nozzle plate 24, the nozzles 30 are provided in rows and then the nozzle rows (nozzle group) are provided in plurality. One nozzle row is configured of 180 nozzles 30.

The vibration plate 25 is a dual structure where a resilient film 32 is laminated on the surface of the supporting plate 31. In the embodiment, the supporting plate 31 is made of a stainless steel plate that is a type of metal plate. The vibration plate 25 is made using a complex plate material where resin film is laminated on the surface of the supporting plate 31 as the resilient film 32. A diaphragm portion 33 that varies a volume of the pressure chamber 28 is provided at the vibration plate 25. In addition, a compliance portion 34 that seals a portion of the reservoir 26 is provided at the vibration plate 25.

The above described diaphragm portion 33 is made by partially removing the supporting plate 31 by an etching process or the like. In other words, the diaphragm portion 33 has an island portion 35 to which a front end surface of a free end of the piezoelectric transducer 20 is bonded and a thin resilient portion 36 that surrounds the island portion 35. The above described compliance portion 34 is made by removing the supporting plate 31 of an area opposed to an opening surface of the reservoir 26 by the etching process or the like similar to the diaphragm portion 33. In addition, the compliance portion 34 has a function as a damper that absorbs pressure variation of liquid that is reserved in the reservoir 26.

Accordingly the front end surface of the piezoelectric transducer 20 is bonded to the above described island portion 35 so that the free end of the piezoelectric transducer 20 is companded, and then the volume of the pressure chamber 28 may be varied. The pressure variation is generated in ink inside the pressure chamber 28 according to the volume variation. Thus, the recording head 2 ejects ink from the nozzles 30 using the pressure variation.

Figure 3:
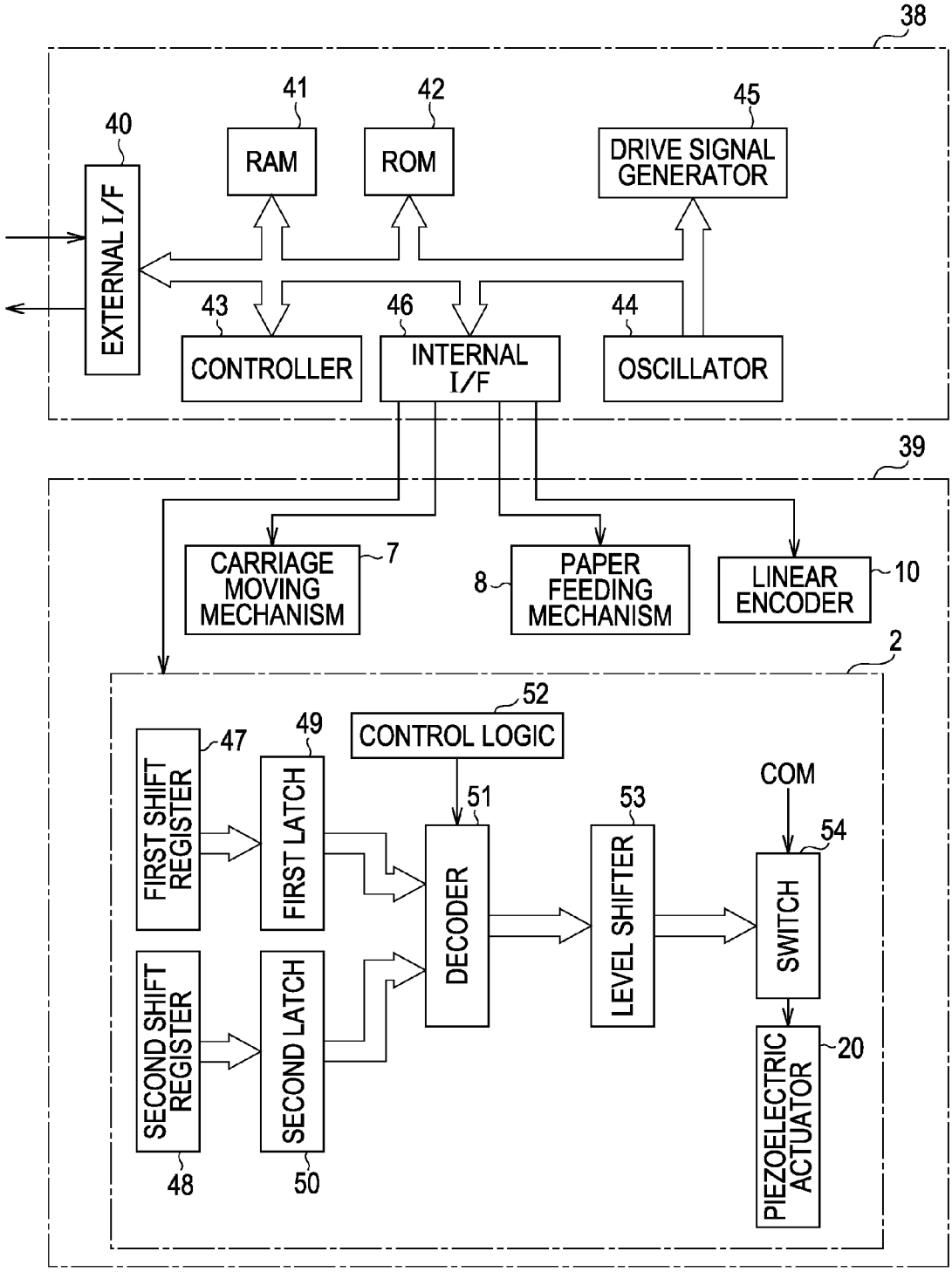
FIG. 3 is a block diagram explaining an electrical configuration of a recording head.

FIG. 3 is a block diagram illustrating an electrical configuration of the printer 1. In the embodiment, the printer 1 is substantially configured of a printer controller 38 and a print engine 39. The printer controller 38 includes an external interface (an external I/F) 40 in which printing data or the like is input from an external device such as a host computer or the like, a RAM 41 that stores all types of data, a ROM 42 that stores a control program or the like for all types of controls, a controller 43 that performs a comprehensive control of each portion according to the control program that is stored in the ROM 42, an oscillator 44 that generates a clock signal, a drive signal generator 45 (one type of drive signal generating unit) that generates a drive signal that is supplied to the recording head 2, and an internal interface (an internal I/F) 46 that outputs dot pattern data, drive signal or the like that are obtained by developing the printing data to each dot. In addition, the print engine 39 is configured of the recording head 2, the carriage moving mechanism 7, the paper feeding mechanism 8 and the linear encoder 10.

The controller 43 functions as a timing pulse generating unit that generates a timing pulse PTS (see FIG. 4) based on the encoder pulse EP that is output from the linear encoder 10. For example, in a configuration where the encoder pulse EP is generated in an interval corresponding to 180 dpi when the recording head 2 moves at a steady speed, if the timing pulse PTS is output with an interval corresponding to 360 dpi of a recording resolution, the controller 43 gradually increases the encoder pulse EP two times so that the timing pulse PTS is generated. In the embodiment, one timing pulse PTS is generated without being gradually increased based on one encoder pulse EP. The timing pulse PTS is a signal that determines a generation start timing of the drive signal that is generated from the drive signal generator 45. In other words, the drive signal generator 45 outputs the drive signal whenever the timing pulse PTS is received. In addition, the controller 43 outputs a latch signal LAT that defines a latch timing of the printing data and a change (or channel) signal CH that defines a selection timing of each of ejection drive pulses that is included in the drive signal. In the embodiment, as described below, a mode (1 PTS·1 LAT) that generates one latch signal LAT with respect to one timing pulse PTS and a mode (1 PTS·2 LAT) that generates two latch signals with respect to one timing pulse PTS are prepared. In the mode of 1 PTS·2 LAT, the controller 43 is configured such that after one latch signal LAT is generated according to the generation of the timing pulse PTS, a second latch signal LAT is generated under a condition that a regular time has elapsed. A distance per pixel that is a unit composing the recording image or the like is set to a value that corresponds to a time in which the recording head 2 moves.

The above described the drive signal generator 45 generates a drive signal COM including a plurality of ejection drive pulses whenever receiving the timing pulse PTS. In other words, the drive signal generator 45 repeatedly generates the drive signal COM in a period based on the above described timing pulse PTS. The printer 1 according to the invention is configured such that ink is ejected from the recording head 2 even during the acceleration movement or during the deceleration movement (the acceleration or deceleration area) of the carriage 4, and the recording of image or text may be performed to the recording area (the liquid ejection area) of the recording paper 6 as the landing object. Accordingly, the printing speed may be improved and the scanning range of the head may be shortened compared to a configuration where the direction is changed over (in other words, performing acceleration or deceleration) to the outside of the recording area so that it may contribute to the more compact size of the apparatus. Meanwhile, in the acceleration or deceleration area, if ink is ejected using the drive signal itself that is used at the steady speed area, the image quality of the recording image is decreased according to a reason described below so that in order to improve the problem, the drive signal generator 45 of the embodiment is configured such that the drive signal is switched over between the steady speed area and the acceleration or deceleration area. The detailed configuration is described below.

Next, an electrical configuration of the recording head 2 is described. As shown in FIG. 3, the recording head 2 includes a shift resister (SR) circuit that is composed of a first shift register 47 and a second shift register 48, a latch circuit that is composed of a first latch circuit 49 and a second latch circuit 50, a decoder 51, a control logic 52, a level shifter 53, a switch 54, and the piezoelectric transducer 20. Thus, each of the shift registers 47 and 48, each of the latch circuits 49 and 50, the level shifter 53, the switch 54, and the piezoelectric transducer 20 are provided in the number as many as the number of the nozzles 30 respectively. In addition, in FIG. 3, a configuration of only one nozzle is shown and the configuration of other nozzles is omitted.

The recording head 2 performs an ejection control of ink (a type of liquid in the invention) based on the printing data (pixel data) SI that is transmitted from the printer controller 38. In the embodiment, an upper bit group of the printing data SI that is composed of 2 bits and a lower bit group of the printing data SI are transmitted to the recording head 2 in the order synchronized with a clock signal CLK. Accordingly, firstly, the upper bit group of the printing data SI is set to the second shift register 48. When the upper bit group of the printing data SI is set to the second shift register 48 regarding all the nozzles 30, next, the upper bit group is shifted to the first shift register 47. Simultaneously, the lower bit group of the printing data SI is set to the second shift register 48.

The first latch circuit 49 is electrically connected to an output port of the first shift register 47 and the second latch circuit 50 is electrically connected to an output port of the second shift register 48. Thus, when latch pulses from the printer controller 38 side are input into each of the latch circuits 49 and 50 respectively, the first latch circuit 49 latches the upper bit group of the recording data and the second latch circuit 50 latches the lower bit group of the recording data. The recording data (the upper bit group and the lower bit group) that are latched at each of the latch circuits 49 and 50 are output to the decoder 51 respectively. The decoder 51 generates pulse selection data in order to select each of the drive pulses that are included in the drive signal based on the upper bit group and the lower bit group of the recording data.

A timing signal from the control logic 52 is also input into the decoder 51. The control logic 52 generates the timing signal synchronized with the input of the latch signal or a channel signal. Each set of pulse selection data that is generated by the decoder 51 is sequentially input into the level shifter 53 from the upper bit side at the timing defined by the timing signal. When the level shifter 53 is functioned as a voltage amplifier and the pulse selection data is [1], an electric signal that is boosted to a voltage that may drive the switch 54, for example, to several tens of volts is output.

The drive signal COM from the drive signal generator 45 is supplied to the input side of the switch 54. In addition, the piezoelectric transducer 20 is connected to the output side of the switch 54. The switch 54 selectively supplies each of the drive pulses that are included in the drive signal COM to the piezoelectric transducer 20 based on the above described pulse selection data. Thus, the switch 54 that performs the above-described operation functions as a selection supply unit. The above described pulse selection data controls the operation of the switch 54. In other words, during a period that the pulse selection data that is input into the switch 54 is [1], the switch 54 is a conductive state and the drive signal COM is supplied to the piezoelectric transducer 20. Meanwhile, during a period in which the pulse selection data that is input into the switch 54 is [0], the switch 54 is an insulated state and the drive signal is not supplied to the piezoelectric transducer 20. In short, the pulse in the period in which [1] is set as the pulse selection data is selectively supplied to the piezoelectric transducer 20. According to the above described switch control, the drive pulse that is included in the drive signal COM may be applied to the piezoelectric transducer 20. In other words, a portion of the drive signal COM may be selectively applied to the piezoelectric transducer 20.

Figure 4:
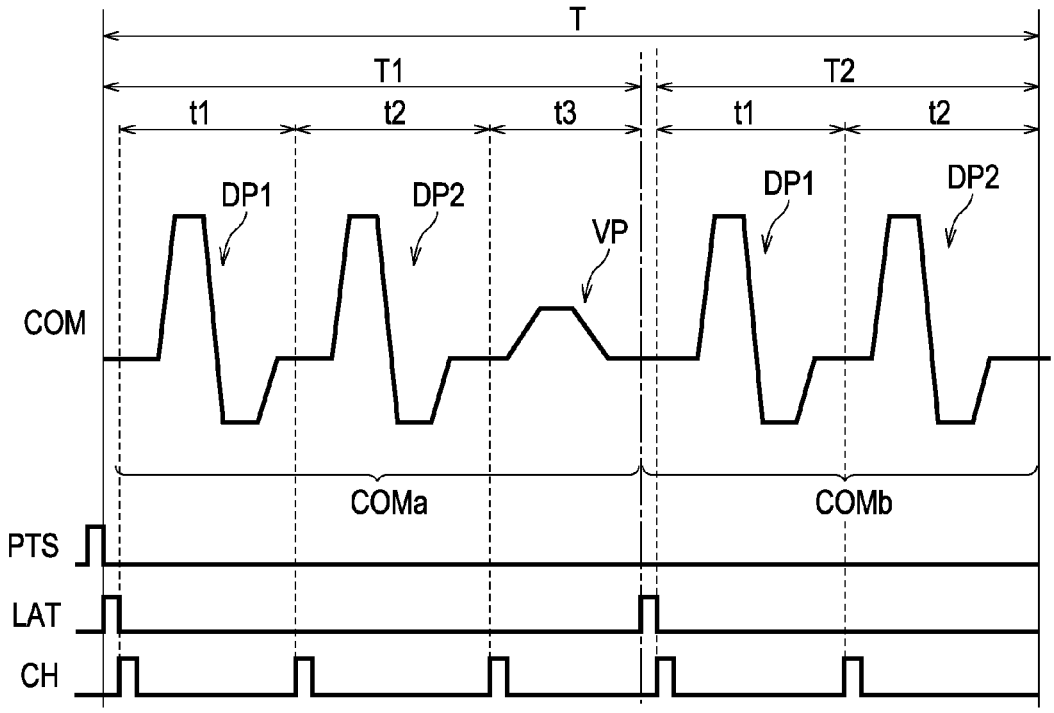
FIG. 4 is a waveform drawing explaining a configuration of a driving signal.

FIG. 4 is a drawing explaining an example of a configuration of the drive signal COM that is generated by the drive signal generator 45 of the embodiment. In addition, a horizontal axis illustrates time and a vertical axis illustrates a potential respectively in the drawing. The illustrated the drive signal COM is a drive signal corresponding to a relatively high speed printing mode in the printer 1. A drive signal may be also generated corresponding to another mode such as a mode that performs recording of the image or the like with relatively high resolution.

The drive signal COM in the embodiment is divided into a first half portion and a second half portion with reference to the latch signal LAT. Specifically, the drive signal COM is configured such that a first unit signal COMa of the first half portion and a second unit signal COMb of the second half portion are included in an unit period T. In other words, the first unit signal COMa is generated at the first half period T1 of the unit period T and the second unit signal COMb is generated at the second half period T2 of the unit period T. In other words, T1 is a waveform length of the first unit signal COMa and T2 is a waveform length of the second unit signal COMb.

The first unit signal COMa is a series of signals including a set of one or more of an ejection drive pulse DP and fine vibration drive pulse VP. In the embodiment, three pulse generation periods t1 to t3 are included at the period T1 that corresponds to a generation period of the first unit signal COMa. A first ejection drive pulse DP1 is generated at the first pulse generation period t1, a second ejection drive pulse DP2 is generated at the second pulse generation period t2 and the fine vibration drive pulse VP is generated at a third pulse generation period t3. Meanwhile, the second unit signal COMb is a series of signals including a set of one or more ejection drive pulses. The fine vibration drive pulse VP is not included at the second unit signal COMb. In the embodiment, two pulse generation periods t1 and t2 are included at the period T2 that corresponds to the generation period of the second unit signal COMb. A first ejection drive pulse DP1 is generated at the first pulse generation period t1 and a second ejection drive pulse DP2 is generated at the second pulse generation period t2.

Figure 5:
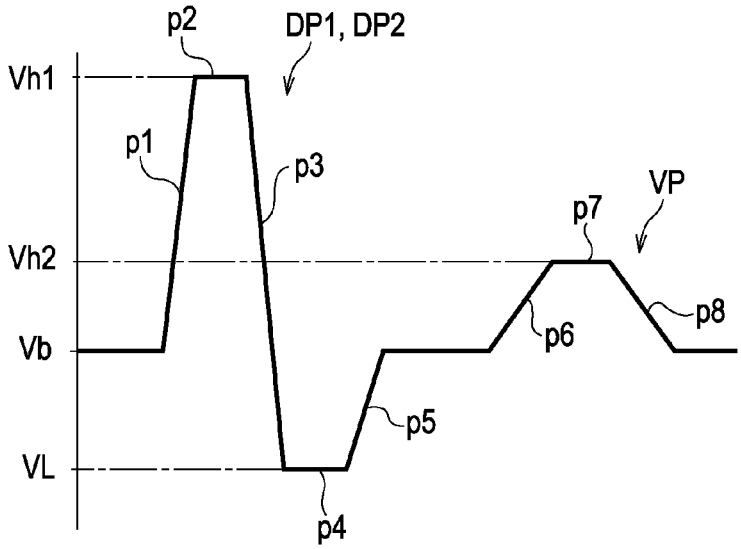
FIG. 5 is a waveform drawing explaining a configuration of an ejection drive pulse and a fine vibration drive pulse.

FIG. 5 is an example of the waveforms of the ejection drive pulse and the fine vibration drive pulse that are included in the drive signal. In the embodiment, the first ejection drive pulse DP1 and the second ejection drive pulse DP2 are the same waveform. The ejection drive pulses DP1 and DP2 are configured of a preliminary expansion portion p1, an expansion hold portion p2, a contraction portion p3, a contraction hold portion p4 and a return expansion portion p5. The preliminary expansion portion p1 is a waveform element in which the potential varies (increases) on a constant slope from the reference potential Vb to the first expansion potential Vh1. The expansion hold portion p2 is a waveform element that is constant at the first expansion potential Vh1 that is an end potential of the preliminary expansion portion p1. In addition, the contraction portion p3 is a waveform element in which the potential varies (decreases) on a constant slope from the first expansion potential Vh1 to the contraction potential VL. The contraction hold portion p4 is a waveform element that is constant at the contraction potential VL. The return expansion portion p5 is a waveform element in which the potential returns from the contraction potential VL to the reference potential Vb.

When the above described the ejection drive pulses DP1 and DP2 are applied to the piezoelectric transducer 20, firstly, the piezoelectric transducer 20 is contracted in an element longitudinal direction by the preliminary expansion portion p1. Accordingly, the pressure chamber 28 expands from a reference volume that corresponds to the reference potential Vb to an expansion volume that corresponds to the first expansion potential Vh1. According to the expansion, a meniscus is largely drawn into the pressure chamber 28 side at the nozzle 30 and ink is supplied inside the pressure chamber 28 through the ink supply port 27 from the reservoir 26 side. Thus, the expansion state of the pressure chamber 28 is maintained during a supply period of the expansion hold portion p2.

After the expansion state is maintained by the expansion hold portion p2, the contraction portion p3 is applied to the piezoelectric transducer 20 so that the piezoelectric transducer 20 expands. Accordingly, the pressure chamber 28 contracts from the expansion volume to a contraction volume that corresponds to the contraction potential VL. Accordingly, ink inside of the pressure chamber 28 is pressurized, the center portion of the meniscus is pushed out to the ejection side at the nozzle 30 and the pushed out portion extends as a liquid column. Continuously, the contraction state of the pressure chamber 28 is maintained in a constant time by the contraction hold portion p4. The meniscus and the liquid column are separated during this time, and the separated portion is ejected from the nozzle 30 as an ink droplet so as to fly toward the recording medium. The return expansion portion p5 is applied to the piezoelectric transducer 20 in accordance with the timing when the ink pressure inside the pressure chamber 28, which is decreased by the ink ejection, is increased again. The pressure chamber 28 returns the expansion to a normal volume according to application of the return expansion portion p5, and the pressure variation (residual vibration) of ink inside the pressure chamber 28 is absorbed, in other words, the vibration is suppressed.

In the embodiment, the fine vibration drive pulse VP is configured of a fine vibration expansion portion p6, a fine vibration expansion hold portion p7 and a fine vibration contraction portion p8. The fine vibration expansion portion p6 is a waveform element in which the potential varies (increases) on a constant slope from the reference potential Vb to the fine vibration expansion potential Vh2. The fine vibration expansion hold portion p7 is a waveform element that is constant at the fine vibration expansion potential Vh2 that is an end potential of the fine vibration expansion portion p6. The fine vibration contraction portion p8 is a waveform element in which the potential returns from the fine vibration expansion potential Vh2 to the reference potential Vb. Here, the fine vibration expansion potential Vh2 is set to be sufficiently lower than the first expansion potential Vh1 of the ejection drive pulse DP.

When the above described fine vibration drive pulse VP is applied to the piezoelectric transducer 20, firstly, the piezoelectric transducer 20 is contracted in the element longitudinal direction by the fine vibration expansion portion p6. Accordingly, the pressure chamber 28 expands from the reference volume that corresponds to the reference potential Vb to the expansion volume that corresponds to the fine vibration expansion potential Vh2. The meniscus is drawn into the pressure chamber 28 side at the nozzle 30 according to the expansion and ink is supplied to inside the pressure chamber 28 through the ink supply port 27 from the reservoir 26 side. Thus, the expansion state of the pressure chamber 28 is maintained during the supply period of the fine vibration expansion hold portion p7. After the expansion state is maintained by the fine vibration expansion hold portion p7, the fine vibration contraction portion p8 is applied to the piezoelectric transducer 20 so that the piezoelectric transducer 20 expands. Accordingly, the pressure chamber 28 contracts from the expansion volume to the reference volume. Accordingly, ink inside the pressure chamber 28 is pressurized to a degree that ink is not ejected from the nozzle 30. The pressure variation is generated relatively gently inside the pressure chamber 28 according to a series of the volume variation of the pressure chamber 28. The meniscus that is exposed to the nozzle 30 is finely vibrated by the pressure variation. Thickened ink near the nozzle 30 is scattered by the fine vibration of the meniscus and as a result, the thickening of ink may be prevented.

Regarding the above described drive signal COM, in the above described mode of 1 PTS·1 LAT, only the first unit signal COMa of the first half is output from the drive signal generator 45 and the second unit signal COMb of the second half is not output. Meanwhile, in the mode of 1 PTS·2 LAT, both the first unit signal COMa of the first half and the second unit signal COMb of the second half are output from the drive signal generator 45. Accordingly, in the mode of 1 PTS·1 LAT, one fine vibration drive pulse VP is output whenever one unit signal is generated while in the mode of 1 PTS·2 LAT, one fine vibration drive pulse VP is output whenever two unit signals are generated. Thus, the second unit signal COMb is shorter than the first unit signal COMa as long as the fine vibration drive pulse VP is not included (in other words, T2<T1). Thus, in the mode of 1 PTS·2 LAT, the generation period as long as two unit signals may be shortened to as long as one fine vibration drive pulse and the ejection of ink may be performed with higher frequency. In the embodiment, mainly, the ejection of ink (in other words, the printing process) is set to be performed by the mode of 1 PTS·2 LAT at the steady speed area where the movement speed of the recording head 2 is constant.

Here, FIG. 6 is a timing chart illustrated as corresponding to a variation of the movement speed of the recording head 2, a generation timing of the timing pulse PTS and a generation timing of the drive signal. In addition, in the drawing, regarding the generation frequency of PTS in the acceleration or deceleration area, as described below, practically it is set higher than the generation frequency of PTS in the steady speed area, however in order to easily understand that the output gap of PTS is varied corresponding to the movement speed of the recording head 2, it is shown in the same state as the generation frequency in the steady speed area.

In addition, FIG. 7 is a schematic view illustrating a landing position of the dot in the acceleration area and the steady speed area (only a portion of both areas is shown). Hereinafter, each of the ejection drive pulses DP1 and DP2 that are included in the unit signals COMa and COMb is sequentially applied to the piezoelectric transducer 20 so that ink is continuously ejected from the nozzle 30. Thus, an example is illustrated regarding a case where ink lands on the recording paper 6, forms a large dot in one pixel area (an area that is virtually set to form a pixel on the landing object) and a predetermined area on the recording paper 6 is painted by the large dot. In FIG. 7, a gap corresponding to one pixel area is illustrated as Px.

As described above, the printer 1 according to the invention is configured such that even during the acceleration movement or during the deceleration movement (acceleration or deceleration area) of the carriage 4, ink is ejected from the recording head 2 and performs the recording of the image or the text in the recording area (liquid ejection area) of the recording paper 6 as the landing object. However, since the movement speed of the carriage 4 in the acceleration or deceleration area is slower than the movement speed of the steady speed area, the generation gap of the encoder pulse EP is long. Thus, the drive signal generator 45 is configured such that the drive signal COM is output under the condition of receiving the timing pulse PTS based on the encoder pulse EP such that the generation interval (the recording period) of the drive signal COM is also long. Thus, even in the acceleration or deceleration area, similar to the steady speed area, when ejection of ink is performed by the mode of 1 PTS·2 LAT, insomuch as the period where the movement speed of the recording head 2 is slow as shown in FIG. 7A, in a two pixel area 2 Px corresponding to one drive signal COM (COMa+COMb), ink deviates and lands on a rear side of the pixel area in the movement direction of the recording head 2. In other words, the dots are formed so as to be biased and a large blank Bc (a portion where ink is not landed) occurs between the next two pixel areas. Accordingly, there is a problem in that stripes and uneven coloration may occur in the image that is recorded on the recording paper 6 so that the image quality is decreased.

Considering the above-described problem, the printer 1 according to the invention is configured such that ink is ejected in the mode of 1 PTS·2 LAT at the steady speed area while ink is ejected in the mode of 1 PTS·1 LAT at the acceleration or deceleration area. In the embodiment, a threshold value is set regarding the movement speed of the recording head 2. If the movement speed of the recording head 2 is less than the threshold value, the mode is set to the mode of 1 PTS·1 LAT and only the first unit signal COMa is output from the drive signal generator 45. In addition, if the movement speed of the recording head 2 is the threshold value or more, the mode is set to the mode of 1 PTS·2 LAT and both the first unit signal COMa and the second unit signal COMb (COMa+COMb) are output from the drive signal generator 45. In the mode of 1 PTS·2 LAT, one timing pulse PTS is generated with respect to one encoder pulse EP while in the mode of 1 PTS·1 LAT, the timing pulse PTS is generated with one encoder pulse EP being two times. Specifically, in the mode of 1 PTS·1 LAT, the generation interval of PTS of this time and PTS of the next time is set to ½ of the interval of EP of last time and EP of the current time. Accordingly, the number of generation of the second drive signal COM2 (COMa) per unit movement distance in the mode of 1 PTS·1 LAT, is two times with respect to the generated number of the first drive signal COM1 (COMa+COMb) per unit movement distance (for example, the movement distance of the recording head 2 as much as two pixels) of the mode of 1 PTS·2 LAT.

In addition, the above described threshold value is set to or slightly less than a value that corresponds to the movement speed of the recording head 2 in the steady speed area.

Accordingly, as shown in FIG. 7B, in the acceleration area where the movement speed of the recording head 2 is slower than that of the steady speed area, the bias of the landing position of ink on the recording paper 6 is decreased, being compared to the configuration where ejection of ink is performed by the mode of 1 PTS·2 LAT at the acceleration or deceleration area. In other words, the misalignment of the landing position of ink is placed within the range of each pixel area. Thus, the blank between dots, which occurs according to the landing position of ink being biased on the recording paper 6, may be decreased. As a result, decreasing of the quality of the recording image or the like may be suppressed.

However, the invention is not limited to the above-described embodiments and may be modified variously based on the claims.

For example, in the above described first embodiment, the configuration is illustrated such that the threshold value regarding the movement speed of the recording head 2 is constant, however the invention is not limited to this configuration, and for example, the threshold value may be different whenever the movement direction of the recording head 2 is switched over a predetermined number of times (in other words, each predetermined number of times of pass).

FIG. 8 is a schematic view describing the difference between the first embodiment and the second embodiment. In the drawing, a large dot that is formed by two ink droplets being landed is shown as one dot. In addition, in the drawing, the movement direction of the recording head 2 in a case where the dot row of the first column is formed and the movement direction of the recording head 2 in a case where the dot row of the second column is formed are reversely directed.

Figure 8A:
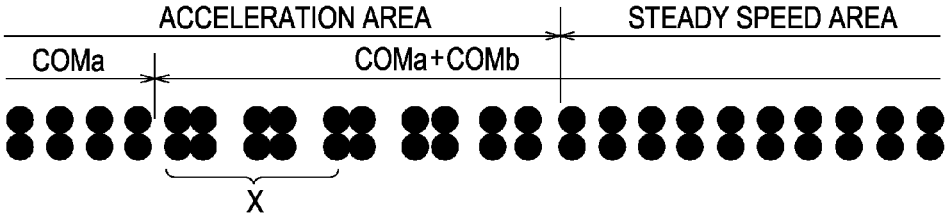
FIG. 8 is a schematic view explaining the difference between a first embodiment and a second embodiment.
Figure 8B:
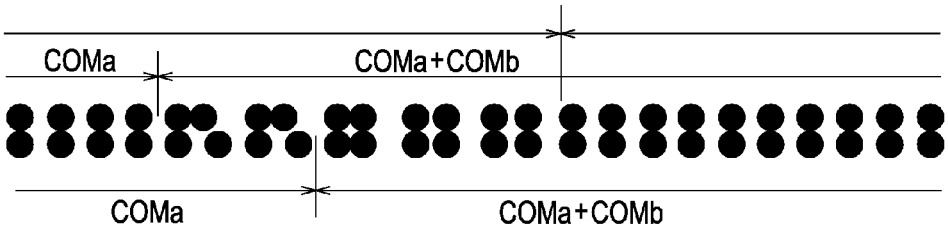

In the configuration that the above described threshold value is constant, since the drive signal is switched over at a specific movement speed, as shown in FIG. 8A, the bias of the landing position of ink is generated according to the switchover of the drive signal at a specific position in the head movement direction (the main scanning direction) in the recording image. In addition, the bias is continued in the direction (sub scanning direction) orthogonal to the head movement direction such that the decreasing of the quality of the recording image or the like may occur. Meanwhile, in the second embodiment shown in FIG. 8B, the threshold value is set to be varied at every switchover of the moving direction of the recording head 2. In this case, in the recording image on the recording paper 6, the position where the bias of the landing position of ink occurs according to the switchover of the drive signal is also varied whenever the movement direction of the recording head 2 is changed. Accordingly, the blank occurring due to the bias of the landing position which is continuous in the sub-scanning direction is suppressed. Decreasing of the quality of the recording image or the like may be further reliably suppressed. In addition, regarding different threshold values, for example, a configuration may be employed such that predetermined two different threshold values are switched over alternatively whenever changing the movement direction of the recording head 2. In addition, for example, a configuration may be employed such that the threshold value is set randomly within a predetermined range. Furthermore, the invention is not limited to the configuration in which the threshold value is varied whenever varying the movement direction of the recording head 2 one time and a configuration may be employed such that the threshold value is varied whenever varying the movement direction of the recording head 2 at predetermined number of times.

Regarding the above described threshold value, in the above described first embodiment, the configuration is illustrated such that the threshold value is set regarding the movement speed of the recording head 2 and the switchover of the drive signal is performed based on the threshold value, however the invention is not limited to this configuration, and for example, a configuration may be employed such that the threshold value is set regarding the movement position of the recording head 2 and the switchover of the drive signal is performed based on the threshold value.

Furthermore, in the above described first embodiment, the configuration is illustrated such that the drive signal generator 45 generates the drive signal COM including the first unit signal COMa and the second unit signal COMb, and in the mode of 1 PTS·1 LAT, the second unit signal COMb of the second half is not output, however the invention is not limited to this configuration. For example, the invention may be configured such that the drive signal generator 45 simultaneously generates the first drive signal COM1 including the first unit signal COMa and the second unit signal COMb, and the second drive signal COM2 including only the first unit signal COMa, and the first drive signal COM1 and the second drive signal COM2 may be switched over according to the above described threshold value.

In addition, the configuration of the drive signal COM (the first unit signal COMa and the second unit signal COMb) is not limited to the first embodiment. The shape or the number of the ejection drive pulse included in the drive signal COM may be set arbitrarily. For example, in the first embodiment, the configuration is illustrated such that the fine vibration drive pulse VP is not included in the second unit signal COMb, however the fine vibration drive pulse VP may be included. Even in this configuration, the effects that are the same as the first embodiment are present. In this case, the first unit signal COMa and the second unit signal COMb are configured with the same waveform, however in the mode of 1 PTS·2 LAT (the steady speed area), the generation period may be shorter by as much as two unit signals than the mode of 1 PTS·1 LAT. Thus it may contribute to the increasing of the printing speed. In other words, as described above, in the mode of 1 PTS·2 LAT, one timing pulse PTS is generated with respect to one encoder pulse EP while in the mode of 1 PTS·1 LAT, the generation interval of the timing pulse PTS is determined based on the interval between the encoder pulse EP of the last time and the encoder pulse EP of the current time. Accordingly, a margin is required to be employed to the waveform length T1 of the first unit signal COMa corresponding to the variation of the gap of the encoder pulse EP. More specifically, at the deceleration movement area, the interval between the encoder pulse EP output the current time and the encoder pulse EP of the next time is shortened with respect to the interval between the encoder pulse EP of the last time and the encoder pulse EP of the current time. Thus, the margin is required to be employed to the waveform length T1 of the first unit signal COMa considering as much as the shortened length. Meanwhile, the second unit signal COMb is completed (completed with only the margin corresponding to the variation of the encoder pulse EP in the steady speed area) without employing the margin of variation so that the waveform length T2 may be shortened.

In addition, in the above-described embodiment, as the pressure generating unit, the piezoelectric transducer 20 of a so-called vertical vibration type is illustrated, however the invention is not limited to the configuration. For example, the invention may employ a piezoelectric oscillator of a so-called flexible vibration type. In this case, regarding the waveform of the illustrated drive signal (the ejection drive pulse), it is the waveform that is reversed in the variation direction of the potential, in other words, the upper and lower direction.

Accordingly, the invention is not limited to a printer as long as the apparatus is a liquid ejection apparatus that uses the ejection drive pulse and may control the ejection of liquid. The invention may be applied to all types of ink jet type recording apparatus such as a plotter, a facsimile apparatus, a copy machine or the like, or a liquid ejection apparatus other than a recording apparatus, for example, a display manufacturing apparatus, an electrode manufacturing apparatus, a chip manufacturing apparatus or the like. Accordingly, in the display manufacturing apparatus, liquid of each color material of R (Red)·G (Green)·B (Blue) is ejected from color material ejection heads. In addition, in the electrode manufacturing apparatus, liquid phased electrode material is ejected from the electrode material ejection head. In the chip manufacturing apparatus, bioorganic liquid material is ejected from the bioorganic substance ejection head.

The entire disclosure of Japanese Patent Application No. 2010-260221, filed Nov. 22, 2010 is expressly incorporated by reference herein.

What is claimed is:

1. A control method of a liquid ejection apparatus, wherein the liquid ejection apparatus comprises:

a liquid ejection head comprising a pressure generating unit configured to generate a pressure variation to liquid inside a pressure chamber communicating with a nozzle, and further configured to eject liquid from the nozzle according to driving of the pressure generating unit; and a drive signal generating unit configured to repeatedly generate a drive signal according to a timing signal that is generated based on movement of the liquid ejection head, wherein the drive signal includes an ejection drive pulse ejecting liquid from the nozzle and a fine vibration drive pulse finely vibrating a meniscus at the nozzle to a degree that the liquid is not ejected from the nozzle, the method comprising:

from the drive signal generating unit, outputting a first unit signal including a set of one or more of the ejection drive pulses and the fine vibration drive pulse and a second unit signal including a set of one or more of the ejection drive pulses and having a generation period that is shorter than that of the first unit signal;

outputting, from the drive signal generating unit according to one timing signal at a steady speed area of the liquid ejection head, a third signal, the third signal comprising both the first unit signal and the second unit signal;

outputting, from the drive signal generating unit according to one timing signal at an acceleration or deceleration area of the liquid ejection head, a fourth signal, wherein the fourth signal comprises the first unit signal, and wherein the fourth signal is different than the third signal.

2. A liquid ejection apparatus comprising:

a liquid ejection head comprising a pressure generating unit configured to generate a pressure variation to liquid inside a pressure chamber communicating with a nozzle, and further configured to eject liquid from the nozzle according to driving of the pressure generating unit; and a drive signal generating unit configured to repeatedly generate a drive signal according to a timing signal that is generated based on movement of the liquid ejection head, where the drive signal includes an ejection drive pulse ejecting liquid from the nozzle and a fine vibration drive pulse finely vibrating a meniscus at the nozzle to a degree that the liquid is not ejected from the nozzle, wherein the drive signal generating unit outputs a first unit signal including a set of one or more of the ejection drive pulses and the fine vibration drive pulse and a second unit signal including a set of one or more of the ejection drive pulses and having a generation period that is shorter than that of the first unit signal, wherein at a steady speed area of the liquid ejection head, a third signal is output according to one timing signal, the third signal comprising both the first unit signal and the second unit signal, and wherein at an acceleration or deceleration area of the liquid ejection head, a fourth signal is output according to one timing signal, wherein the fourth signal comprises the first unit signal, and wherein the fourth signal is different than the third signal.

3. The liquid ejection apparatus according to claim 2, wherein the drive signal generating unit performs switchover of the drive signal based on a threshold value regarding movement speed of the liquid ejection head.

4. The liquid ejection apparatus according to claim 2, wherein the drive signal generating unit performs switchover of the drive signal based on a threshold value regarding movement position of the liquid ejection head.

5. The liquid ejection apparatus according to claim 3, wherein the threshold value varies whenever a movement direction of the liquid ejection head is switched over in predetermined times.

6. The apparatus of claim 2, wherein the fourth signal does not include the second unit signal.

* * * * *